US008925538B2

(12) United States Patent
Chong

(10) Patent No.: US 8,925,538 B2
(45) Date of Patent: Jan. 6, 2015

(54) REUSABLE DISTRACTION DEVICE SIMULATOR

(71) Applicant: Carlton Chong, North York (CA)

(72) Inventor: Carlton Chong, North York (CA)

( * ) Notice: Subject to any disclaimer, the term of this patent is extended or adjusted under 35 U.S.C. 154(b) by 0 days.

(21) Appl. No.: 13/677,512

(22) Filed: Nov. 15, 2012

(65) Prior Publication Data

US 2014/0130695 A1 May 15, 2014

(51) Int. Cl.

| | |
|---|---|
| ***F42B 8/08*** | (2006.01) |
| ***F42B 8/26*** | (2006.01) |
| ***F41B 11/80*** | (2013.01) |
| ***F42B 12/36*** | (2006.01) |

(52) U.S. Cl.

CPC . *F41B 11/80* (2013.01); *F42B 8/26* (2013.01); *F42B 12/36* (2013.01)

USPC ..... 124/73; 124/57; 124/70; 102/498; 102/370; 102/334

(58) Field of Classification Search

USPC ..... 102/334, 335, 370, 375, 395, 398, 530; 124/57, 70, 73, 75

See application file for complete search history.

(56) References Cited

U.S. PATENT DOCUMENTS

| | | | | | |
|---|---|---|---|---|---|
| 4,455,940 | A * | 6/1984 | Furuike | 102/228 |
| 4,944,521 | A * | 7/1990 | Greeno | 473/577 |
| 4,976,201 | A * | 12/1990 | Hamilton | 102/323 |
| 5,354,225 | A * | 10/1994 | Hix | 446/180 |
| 5,654,523 | A * | 8/1997 | Brunn | 102/498 |
| 6,871,594 | B1 * | 3/2005 | Estrella | 102/498 |
| 7,784,455 | B1 * | 8/2010 | Chong | 124/73 |
| 8,517,005 | B2 * | 8/2013 | Chu | 124/65 |
| 2010/0199960 | A1 * | 8/2010 | Chong | 124/57 |
| 2011/0067593 | A1 * | 3/2011 | Klein | 102/439 |
| 2011/0311948 | A1 * | 12/2011 | Lu et al. | 434/11 |

* cited by examiner

*Primary Examiner* — Bret Hayes
*Assistant Examiner* — Derrick Morgan
(74) *Attorney, Agent, or Firm* — Elias Borges

(57) ABSTRACT

Here is disclosed a reusable pneumatic distraction device having a housing which encloses a first and a second gas reservoir which are configured to contain a quantity of high and low pressure gas, respectively. A valve member seals off an exhaust in the first gas reservoir, the valve member movable between a closed position sealing the exhaust and an open position. The device also includes a pneumatic drive for urging the valve towards its opened position. The pneumatic drive configured to apply a lower urging force followed by a larger urging force as the valve opens. The device is also provided with a lock pin releasably coupled to the valve for preventing the valve from moving towards its open position. Finally, the device includes a delay mechanism to delay the opening of the piston when the lock pin is released.

10 Claims, 9 Drawing Sheets

REUSABLE DISTRACTION DEVICE SIMULATOR

CROSS REFERENCE TO RELATED APPLICATION

This application claims priority from U.S. provisional patent application No. 61/559,843 dated Nov. 15, 2011, the entirety of which is incorporated herein by reference.

FIELD OF THE INVENTION

The invention relates generally to devices used to train military and law enforcement personnel in the deployment of non lethal distraction devices.

BACKGROUND OF THE INVENTION

Distraction devices which employ the use of explosives have been available for operational use for dangerous forced entry situations where law enforcement or military agents are faced with the prospect of entering an unknown area under fire. The proper usage of pyrotechnic distraction methods is of high importance to prevent injuries or fatalities of both agents and suspects within the areas agents are entering. Law enforcement and military agents are trained through a program of situational training where DDS may be used. These simulators can be dummy or inert placeholders. Often inert devices are either expended distraction devices with no explosive charge or a physical analogue such as a plastic model of a distraction device. Alternatively, some operational distraction devices can be loaded with a training charge which contains approximately one third of the amount of pyrotechnic material of an operational charge.

While these prior operational distraction devices and training DDS are useful training tools, there are a number of draw backs associated with previous designs. Inert or dummy simulators do not emit a loud report. The lack of report reduces the effectiveness of training because trainees do not have an aural queue to initiate their actions. Trainees using inert and dummy simulators must imagine that their training device has detonated and continue with their practice actions. Trainees using operational devices charged with a reduced training load are exposed to an explosive hazard as well pyrotechnic charges expose a training site to fire or blast damage. Additionally, reduced training charges are expensive and are logistically difficult to handle and ship since they are considered to be hazardous material. A device which is safe, effective, economical to use, and logistically manageable is therefore required.

SUMMARY OF THE INVENTION

In accordance with one aspect of the present invention, there is provided a reusable pneumatic distraction device which is convenient, economical and safe to use. The distraction device includes a housing which encloses a first and a second gas reservoir, the first gas reservoir configured to contain a quantity of high pressure gas and the second gas reservoir configured to contain a quantity of lower pressure gas. A valve member is provided for sealing off an exhaust in the first gas reservoir, the valve member movable between a closed position wherein the valve member seals the exhaust closed and an open position wherein gas is free to rapidly flow out of the exhaust. The device further includes a pneumatic drive for urging the valve towards its opened position by a difference in gas pressure between the first and second gas reservoirs. The pneumatic drive is configured to apply a lower initial urging force followed by a larger urging force to the valve as the valve moves out of its closed position. The device is also provided with a lock pin releasably coupled to the valve for preventing the valve from moving towards its open position. Finally, the device includes a delay mechanism to delay the opening of the piston when the lock pin is released.

In accordance with another aspect of the present invention, there is provided a pneumatic distraction device which is reusable. The device includes a housing enclosing a cavity divided into first and second gas reservoirs configured to store a quantity of higher pressure and lower pressure gas, respectively. The first gas reservoir is coupled to an exhaust port with a valve member interposed between the first gas reservoir and the exhaust. The valve member is movable between a closed position wherein the valve member seals off the exhaust and an open position wherein gas is free to rapidly flow out of the exhaust. A valve stem having opposite first and second ends is also provide with the valve being coupled to the first end and a piston being formed on the valve stem between the valve and the second end. The piston and the first and second gas reservoirs are dimensioned and configured such that the piston divides the first gas reservoir from the second gas reservoir. A lock pin is releasably mounted to the second end of the valve stem for holding the valve in its closed position. A discharge opening is formed on the housing which communicates with the second gas reservoir, the flow of gas through the discharge opening being slowed by a porous plug contained in the discharge opening. The piston and the second gas reservoir are configured such that when the lock pin is released, the piston is urged to move the valve towards its open position as a result of a difference in gas pressure between the first and second gas reservoirs. The piston and second gas reservoirs are configured to apply a lower initial urging force followed by a larger urging force to the valve as the valve moves out of its closed position. The porous plug is configured to slow the escape of gas from the second gas reservoir and thereby slow the movement of the piston.

In accordance with another aspect of the present invention, there is provided a reusable pneumatic distraction device. The device includes a housing which encloses first and second gas reservoirs, the first gas reservoir configured to contain a quantity of high pressure gas and the second gas reservoir configured to contain a quantity of lower pressure gas. A valve member is provided for sealing off an exhaust in the first gas reservoir, the valve member movable between a closed position wherein the valve member seals the exhaust closed and an open position wherein gas is free to rapidly flow out of the exhaust. A piston is coupled to the valve and interposed between the first and second gas reservoirs, the piston moving the valve towards its opened position by a difference in gas pressure between the first and second gas reservoirs. The piston and second gas reservoirs are configured to apply a lower initial urging force followed by a larger urging force to the valve as the valve moves out of its closed position. The device also includes a lock pin releasably coupled to the valve for preventing the valve from moving towards its open position. Finally, the device also includes a porous plug blocking a discharge opening in the second gas reservoir to slow the depressurization of the second gas reservoir and thereby slow the movement of the piston when the lock pin is released.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention.

DESCRIPTION OF THE DRAWINGS

In the drawings like characters of reference indicate corresponding parts in the different figures.

DETAILED DESCRIPTION OF THE INVENTION

Figure 1:
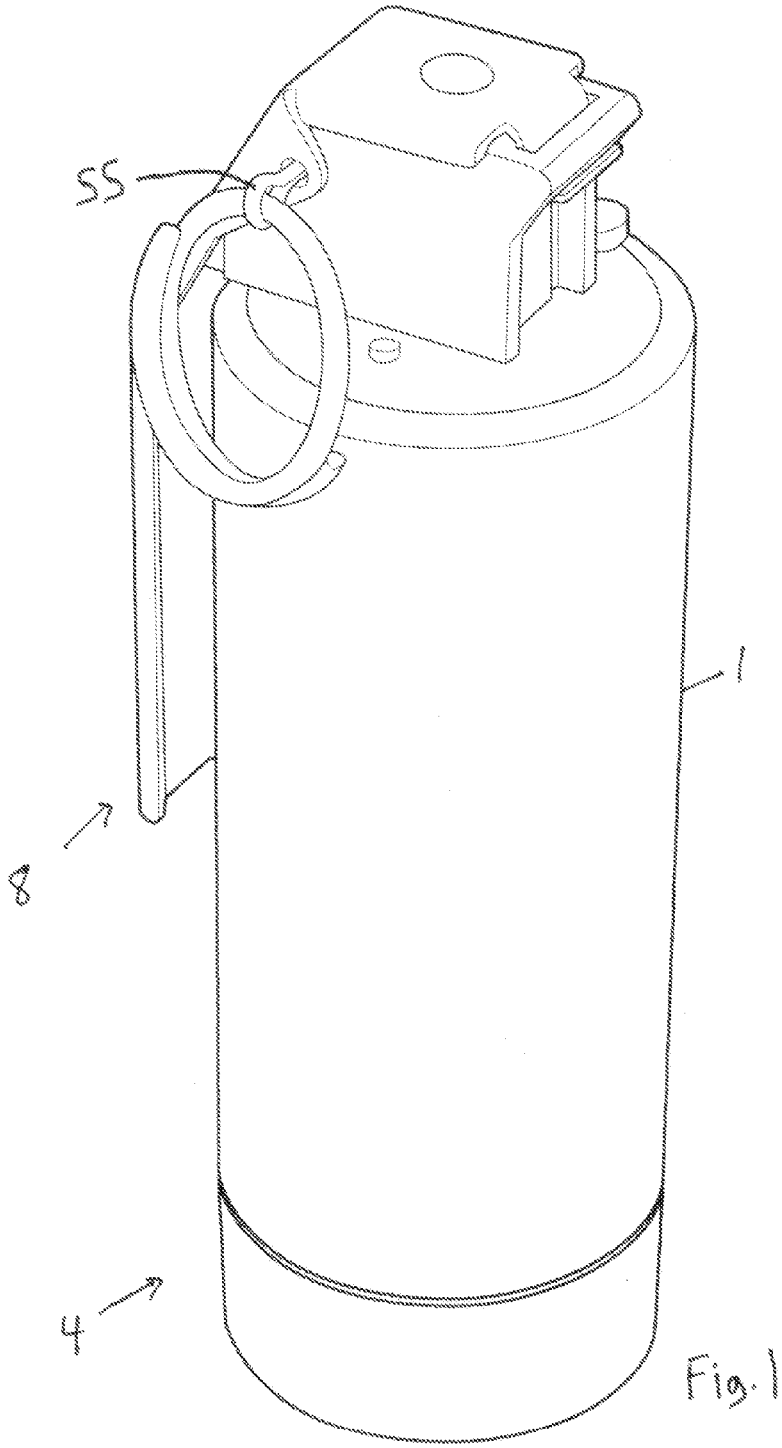
FIG. 1. is a perspective view of a distraction device simulator made in accordance with the present invention (hereinafter called DDS).
Figure 2:
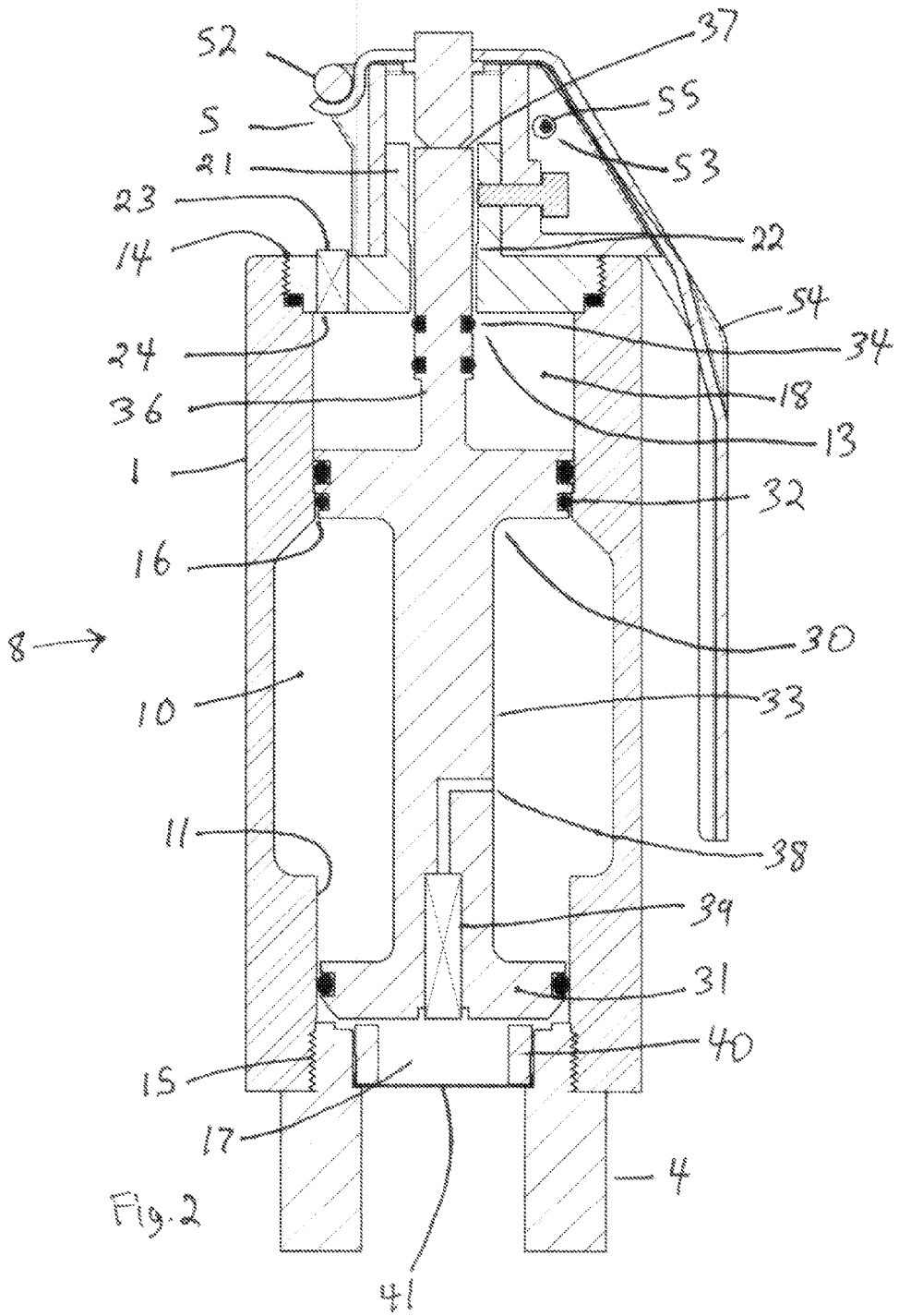
FIG. 2. is a long sectional view of the DDS shown in FIG. 1 shown in its locked configuration.
Figure 6:
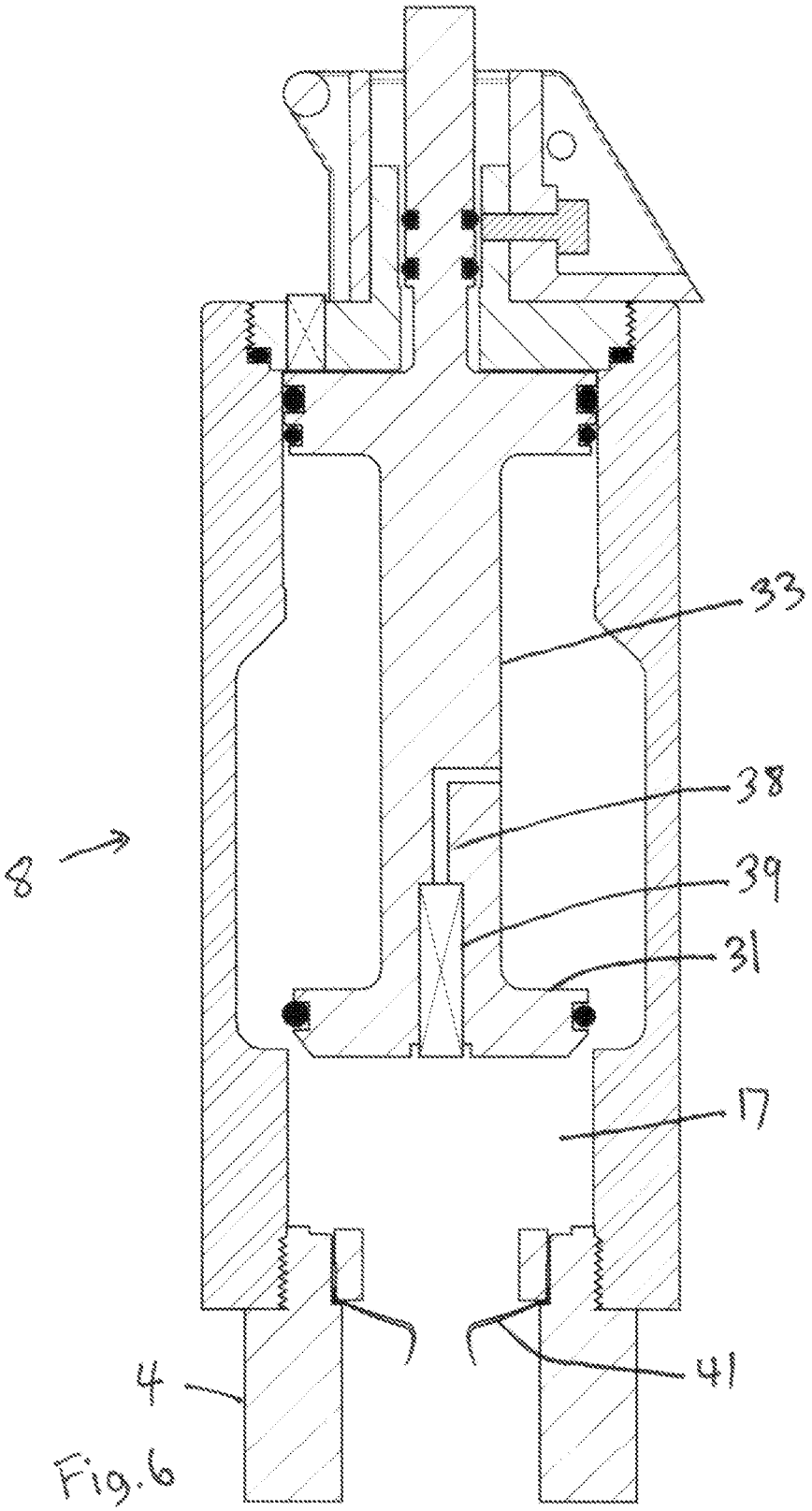
FIG. 6. is a long sectional view of the DDS in its fifth configuration at the end of its discharge cycle.

Referring firstly to FIG. 2, a simulator made in accordance with the present invention, shown generally as item 8, includes a housing 1 with threaded ends 14 and 15. The simulator further includes a gas reservoir 10 for pressurizing the discharge opening 17. Valve 31 is movable between a closed state where the valve prevents the flow of pressurized gas from reservoir 10 to discharge opening 17, and an open state as shown in FIG. 6. As shall be explained later, valve 31 is biased towards its open position by pneumatic pressure contained in gas reservoir 10. Trigger mechanism 5 includes a removable pin 55 inserted into hole 53. The removable handle 54 pivots around post 52 and is locked in place by pin 55.

Collar 21 has a passage 22 dimensioned to receive seal 34, seated on shaft 36 which is coupled to valve 31. When pin 55 remains in place in hole 53, the trigger mechanism 5 is placed into its locked state and it prevents valve 31 from moving into its open position. Furthermore handle 54 is retained against the side of housing 1 while the device 8 is held by the user's hand (not shown). Trigger mechanism 5 is released into its unlocked state by pulling out pin 55 from hole 53 and by the user releasing handle 54, which frees handle 54 to pivot around post 52, which frees end 37, thereby permitting the valve 31 to move into its open state as shown in FIG. 6. Delay mechanism 13 consists of a gas reservoir 18 for holding a quantity of gas, preferably air, the reservoir having a discharge opening 24 for slowly letting the gas contained in the reservoir to escape. A piston 30 is contained in the reservoir and is coupled to valve 31 by shaft (valve stem) 33.

Valve 31 is positioned in the cylindrical passage (bore) 11 which has a smaller cross sectional diameter than reservoir bore 16; therefore, when pin 55 is removed from hole 53, and handle 54 is not retained against the housing 1, the gas pressure in chamber 10 acts against piston 30 towards collar 21 pulling valve 31 along with it and pushing seal 34 to close opening 22.

Figure 3:
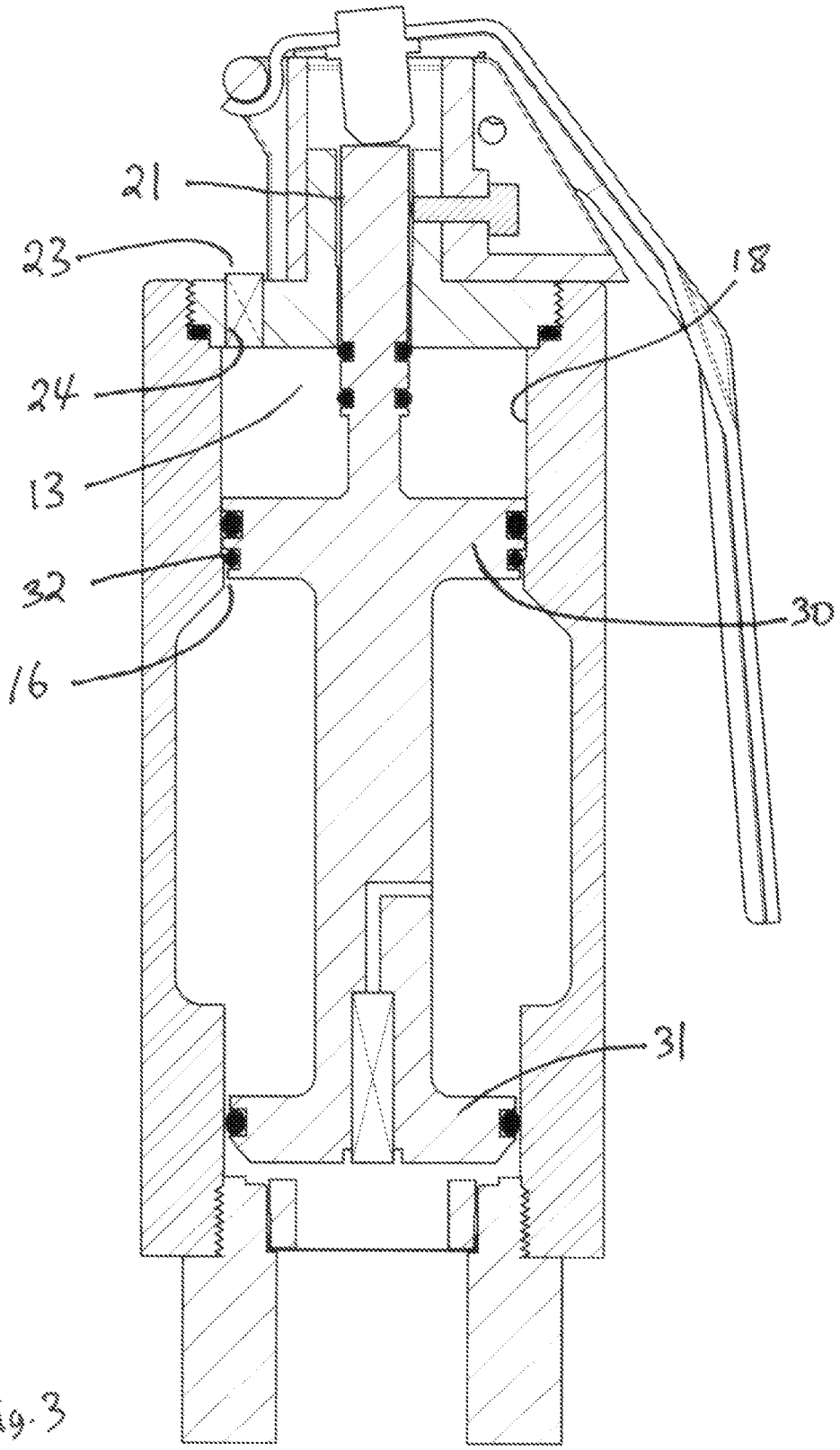
FIG. 3. is a long sectional view of the DDS in its second configuration after activation.
Figure 8:
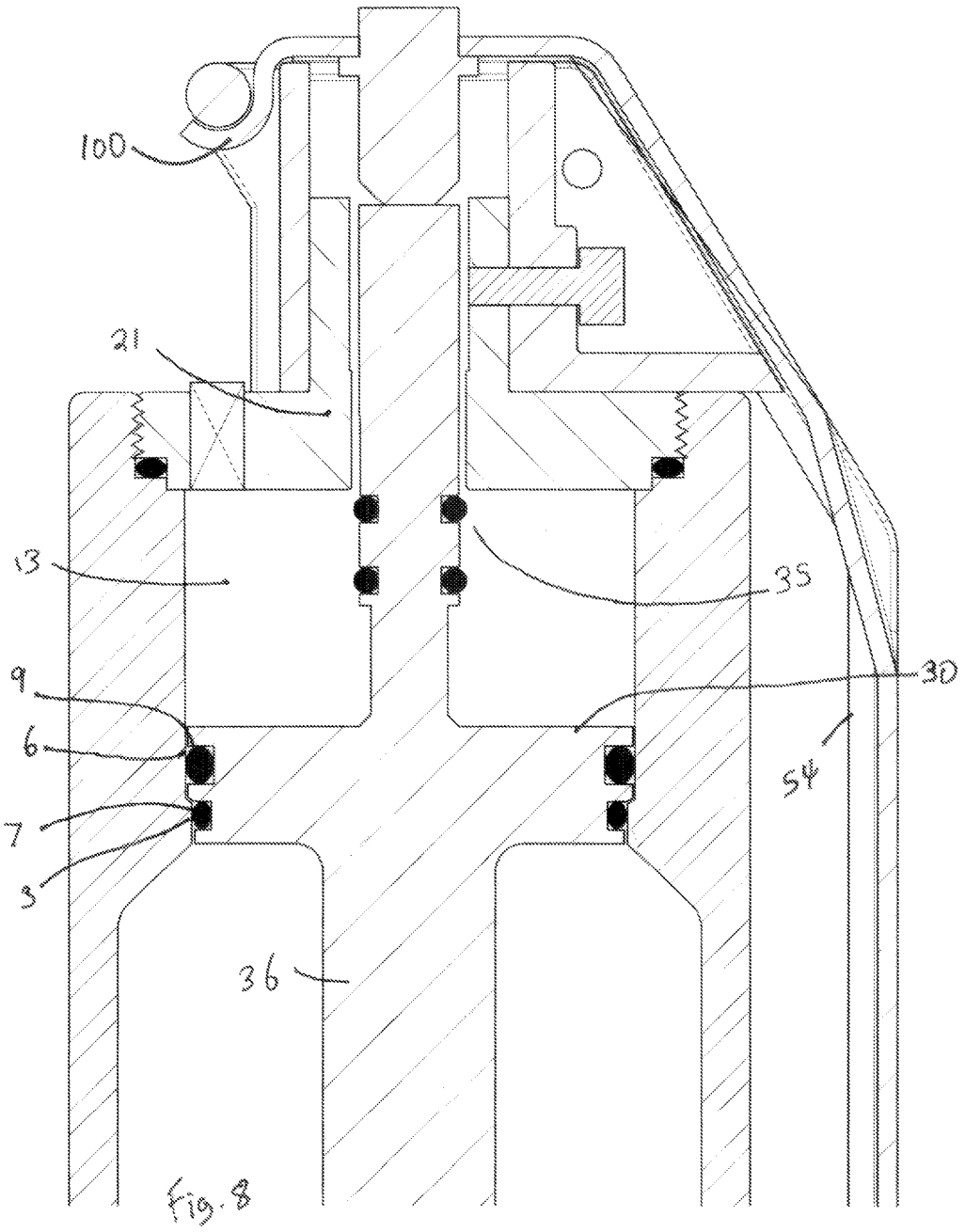
FIG. 8. is a magnified sectional view of the pneumatic drive mechanism of the DDS when the valve portion is in its fully closed position.
Figure 9:
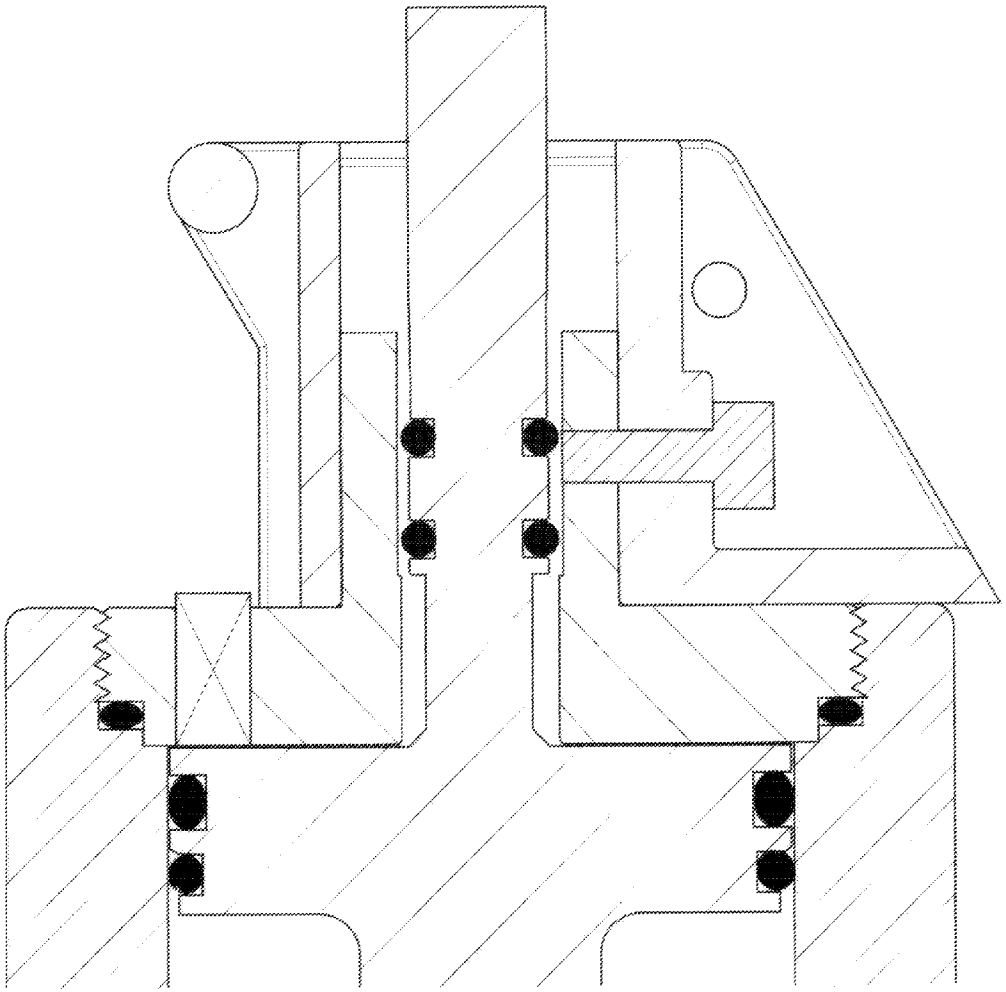
FIG. 9. is a magnified sectional view of the trigger and delay mechanism of the DDS when the valve is in its fully opened position.

Referring to FIG. 3 depicting delay mechanism 13 in a triggering position, as piston 30 moves towards collar 21, it forces gas out of the reservoir 18 through discharge opening 24. Discharge opening 24 is partially obstructed by a restriction (plug) 23, preferably a packed porous material, seal 32 is pushed out of bore 16 which is smaller than the reservoir bore 18 which results in a higher difference in opposing force acting between piston 30 and valve 31. Since discharge opening 24 is partially blocked by porous plug 23, it takes a short delay between 0.5 and 3 seconds to empty the gas reservoir, thereby delaying the movement of valve 31. As best seen in FIG. 8, gas reservoir 18 has a smooth cylindrical wall having portions 3 and 6, with portion 3 being slightly narrower than portion 6. Seal 32 actually consists of two separate seals 7 and 9. Seal 7 is configured to form a seal around piston 30 at portion 3 while seal 9 is configured to form a seal around piston 30 at portion 6. It will be appreciated that as piston 30 moves, there is a slight widening in the effective diameter of the piston since seal 9 is slightly wider than seal 7. This means that when the pin is pulled the initial pneumatic biasing force acting on piston 30 when seal 7 is contacting narrower portion 3 is less than when only seal 9 contacts wider portion 6. This two stage application of biasing force applied to the piston, with the initial force being lower, prevents damage to hook portion 100 of spoon of handle 54. It has been discovered that without this two stage application of biasing force, too much force would be applied to the handle and hooks rendering the device usable only once. It should also be appreciated that the two stage application of force permits a higher second stage application of force making it easier to overcome the friction of the seals of both the piston and the valve. This in turn makes it much easier to produce a device with more consisting timing of the delay between the release of the device and the subsequent loud burst because differences in seal friction become less important.

Figure 4:
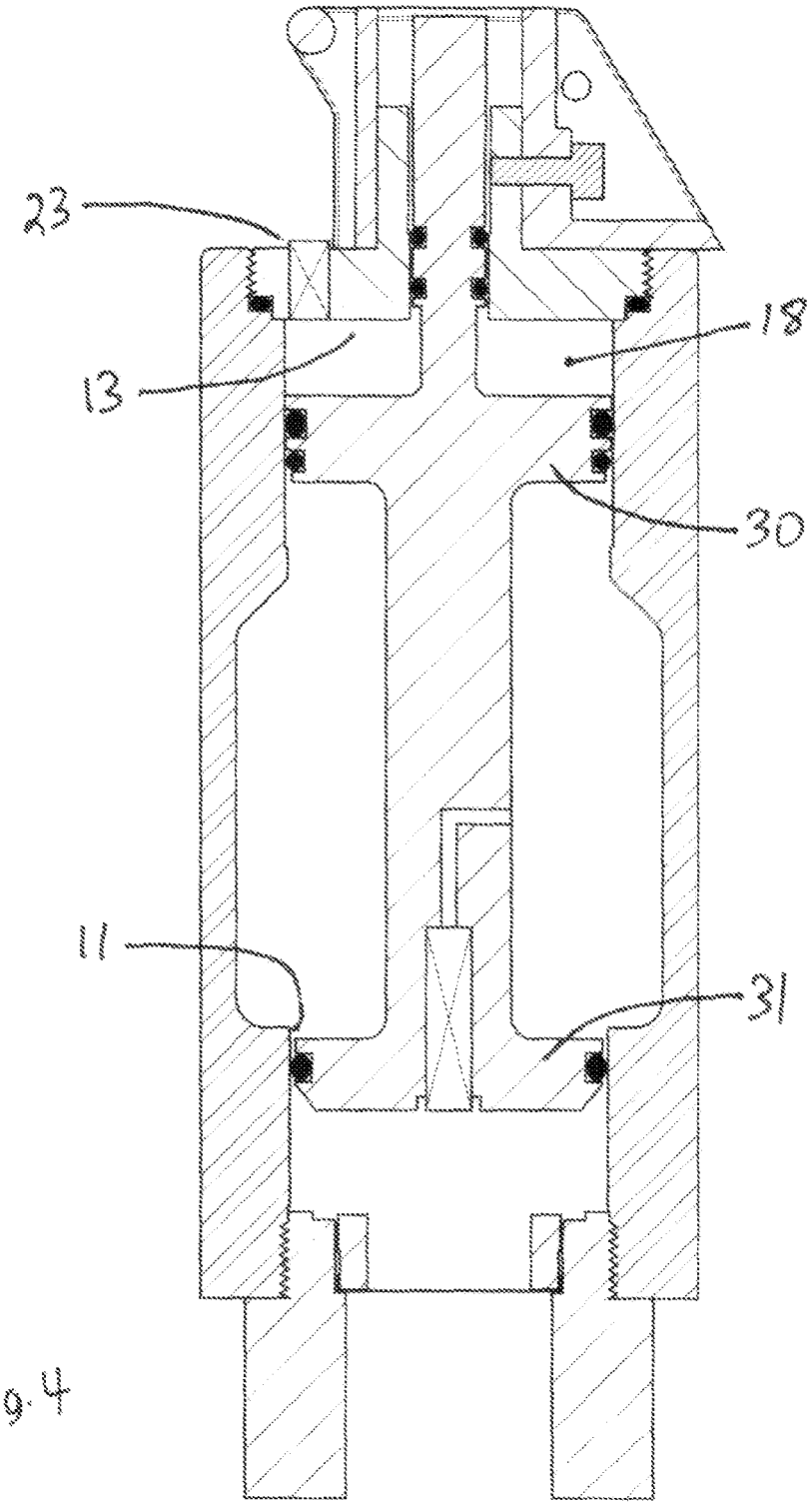
FIG. 4. is a long sectional view of the DDS in its third configuration at the beginning of its delay motion.

Referring to FIG. 4 depicting delay mechanism 13 in an intermediary position during its delay motion, air stored in reservoir 18 has been compressed by pressure exerted by piston 30 and is gradually escaping through restriction 23. Piston 31 is moving closer to the end of discharge bore 11.

Figure 5:
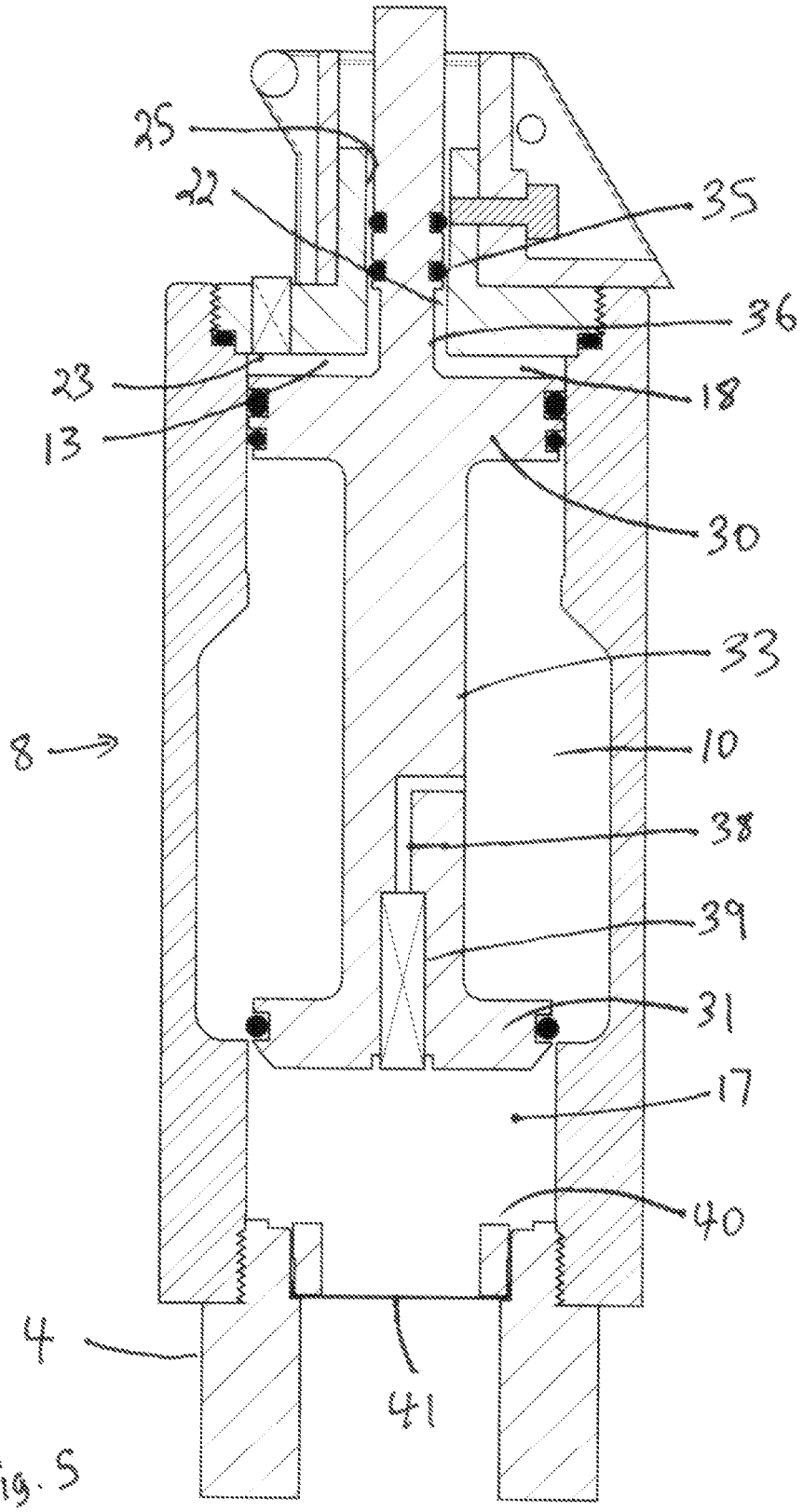
FIG. 5. is a long sectional view of the DDS in its fourth configuration at the moment that its delay has expired and the trigger mechanism has begun to open.
Figure 7:
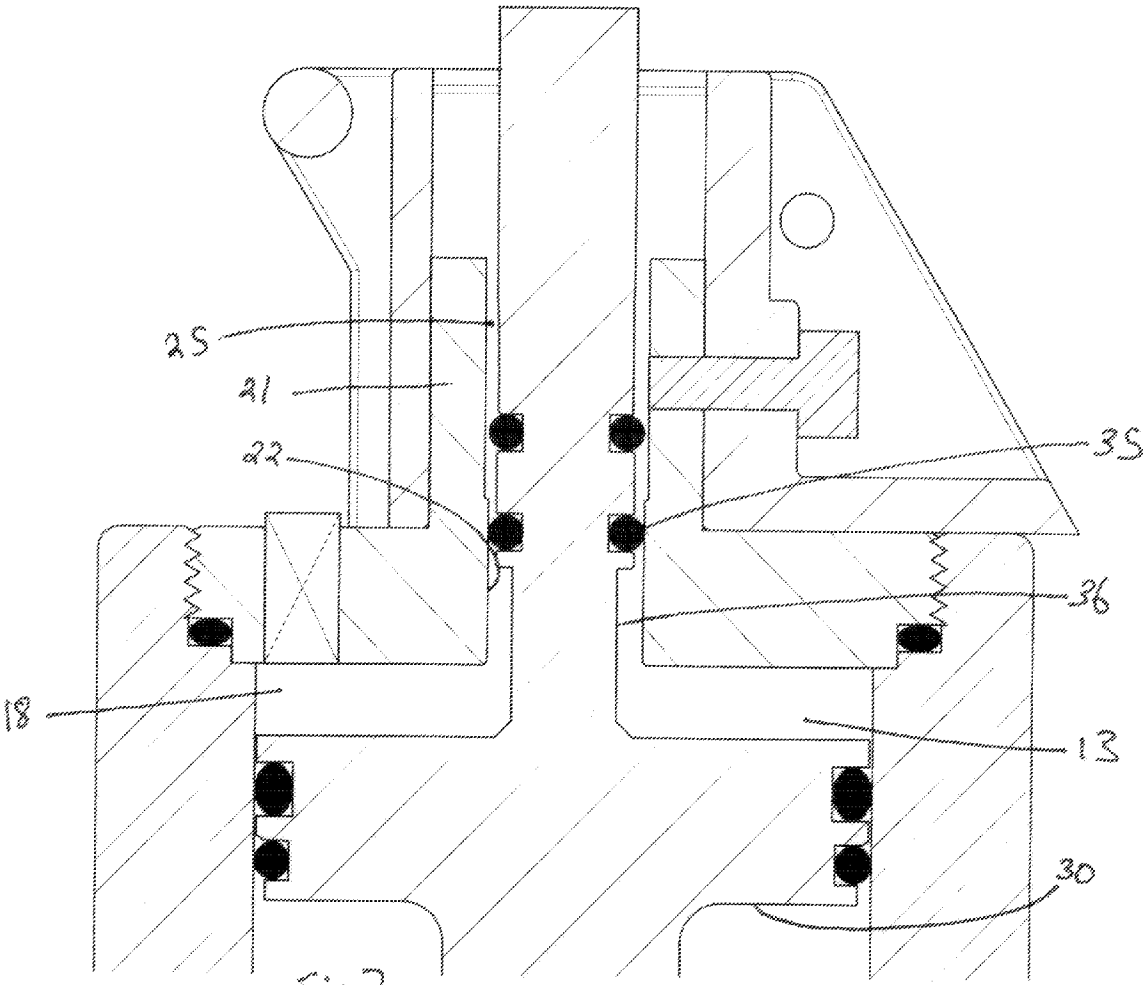
FIG. 7. is a magnified sectional view of the trigger and delay mechanism of the DDS at the end of its delay phase.

Referring to FIGS. 5 and 7, delay mechanism 13 includes a seal 35 seated in shaft 36 which seals the shaft as it moves within collar 21. Partway through the discharge motion of piston 30, seal 35 is pushed past a narrower first (or sealing) bore 22 which opens to a larger diameter second bore 25. A passage is opened between seal 35 and bore 25 which allow a faster expulsion of gas than would be permitted through discharge restriction 23. The rapid drop of pressure within reservoir 18 allows a fast movement of piston 30, coupled to valve 31, by shaft 33, which results in a rapid opening of valve 31 into its fully open position shown in FIG. 6.

As can also be seen in FIG. 8, seal 35 is placed along shaft 36 such that there is a slight gap between seal 35 and bore 22 when the shaft is in its fully closed position. This permits air in reservoir 13 to quickly escape through collar 21 until seal 35 makes contact with the collar. Since the dimensions of shaft 36 can be precisely controlled by machining the part, this eliminates the need to precisely control the dimensions of handle 54 and hook 100 while still maintaining accurate delay timing. This in turn allows for a more economical construction.

Referring back to FIG. 6, the bottom of simulator 8 is provided with a removable cap 4. Shaft 33 is provided with an internal passage 38 having a one way valve 39. When cap 4 is removed, and the simulator is placed in its locked state depicted in FIG. 2, the user can pressurize chamber 10 by applying an air line (not shown). Cap 4 can then be replaced.

Referring to FIG. 6, cap 4 includes a bore which receives a press fitted or welded in ring 40 which retains a burst disc 41, made of a thin material, preferably polyester film. Opening of valve 31 allows gas to escape into discharge opening 17 which exerts pressure against burst disc 41. The subsequent rupture of disc 41 emits a loud report.

The present invention has many advantages over the prior art. In particular, the use of compressed gas presents a much lower risk of injury to users as well as reduced risk of damage to training facilities. Furthermore, the low cost of consumable refill gas and burst elements is economical in comparison to the cost of pyrotechnic consumables. Furthermore the present invention may be used without a burst element as the rapid opening of the valve assembly can still emit a loud report despite omission of a burst element. Furthermore, the robust design of the valve mechanism and the delay mechanism permits easy refilling of the simulator as well as reliable performance. The specific implementation specified above has the benefit of requiring a low holding force against the removable handle 54. In the locked state, low holding forces are exerted on the handle which results in reduced deformation of handle features. Upon release of the handle, through pin removal and throwing, the delay mechanism moves into a high force mode which makes variations in static friction present in various sealing surfaces insignificant to provide a more consistent delay performance. Finally, the compact design of the invention allows the exterior of the device to accurately replicate the form, functioning, and mass of specific operational distraction devices used in the field.

A specific embodiment of the present invention has been disclosed; however, several variations of the disclosed embodiment could be envisioned as within the scope of this invention. It is to be understood that the present invention is not limited to the embodiments described above, but encompasses any and all embodiments within the scope of pending claims to be added to this provisional application.

Therefore, what is claimed is:

1. A reusable pneumatic distraction device comprising:

a. A housing enclosing a cavity divided into first and second gas reservoirs configured to store a quantity of higher pressure and lower pressure gas, respectively, the first gas reservoir being coupled to an exhaust port, a valve member interposed between the first gas reservoir and the exhaust, the valve member movable between a closed position wherein the valve member seals off the exhaust and an open position wherein gas is free to rapidly flow out of the exhaust;

b. A valve stem having opposite first and second ends, the valve being coupled to the first end and a piston being formed on the valve stem between the valve and the second end, the piston and the first and second gas reservoirs being dimensioned and configured such that the piston divides the first gas reservoir from the second gas reservoir;

c. The second gas reservoir having a cylindrical wall dimensioned to receive the piston, the piston having a seal for contacting the cylindrical wall, the cylindrical wall having a narrower portion towards the first gas reservoir;

d. A lock pin mounted coupled to the valve stem for holding the valve in its closed position;

e. A discharge opening formed on the housing and communicating with the second gas reservoir, the flow of gas through the discharge opening being slowed by a porous plug contained in the discharge opening;

f. The piston and the second gas reservoir being configured such that when the lock pin is released, the piston is urged to move the valve towards its open position as a result of a difference in gas pressure between the first and second gas reservoirs applying a pneumatic force on the valve, the second gas reservoir being configured such that the effective diameter of the piston increases and the pneumatic force increases as the valve moves out of its closed position, the porous plug being configured to slow the escape of gas from the second gas reservoir and thereby slow the movement of the piston.

2. A reusable pneumatic distraction device comprising:

a. A housing enclosing first and second gas reservoirs, the first gas reservoir configured to contain a quantity of high pressure gas and the second gas reservoir configured to contain a quantity of lower pressure gas, a valve member sealing off an exhaust in the first gas reservoir, the valve member movable between a closed position wherein the valve member seals the exhaust closed and an open position wherein gas is free to rapidly flow out of the exhaust;

b. A piston coupled to the valve and interposed between the first and second gas reservoirs, the second gas reservoir having a cylindrical wall dimensioned to receive the piston, the piston having a seal for contacting the cylindrical wall, the cylindrical wall having a narrower portion towards the first gas reservoir, the piston applying a pneumatic force on the valve urging the valve towards its opened position by a difference in gas pressure between the first and second gas reservoirs, the second gas reservoir being configured such that the effective diameter of the piston increases and the pneumatic force increases as the valve moves out of its closed position;

c. A lock pin releasably coupled to the valve for preventing the valve from moving towards its open position;

d. A porous plug blocking a discharge opening in the second gas reservoir to slow the depressurization of the second gas reservoir and thereby slow the movement of the piston when the lock pin is released.

3. The reusable pneumatic distraction device of claim 1 wherein the housing has a collar with a smooth bore through which the second end of the valve stem passes, a seal formed on the second end of the valve stem to prevent gas from escaping through the collar, the seal passing from a first portion of the bore to a second portion of the bore as the valve is moved towards its open position, the second portion of the bore being wider than the seal to permit the rapid depressurization of the second gas reservoir and subsequent rapid opening of the valve when the seal moves to the second portion of the bore.

4. The reusable pneumatic distraction device of claim 2 wherein the valve is coupled to the piston by a valve stem having opposite first and second ends, the valve being formed on the first end and the piston being formed on the valve stem between the first and second ends, the housing having a collar with a smooth bore through which the second end of the valve stem passes, a seal formed on the second end of the valve stem to prevent gas from escaping through the collar, the seal passing from a first portion of the bore to a second portion of the bore as the valve is moved towards its open position, the second portion of the bore being wider than the seal to permit the rapid depressurization of the second gas reservoir and subsequent rapid opening of the valve when the seal moves to the second portion of the bore.

5. The distraction device of claim 1 further comprising a removal cap coupled to the housing at the exhaust, the removable cap dimensioned to cover over the exhaust, the removable cap having a diaphragm configured to burst loudly when gas rapidly passes through the exhaust.

6. The distraction device of claim 2 further comprising a removal cap coupled to the housing at the exhaust, the removable cap dimensioned to cover over the exhaust, the removable cap having a diaphragm configured to burst loudly when gas rapidly passes through the exhaust.

7. The distraction device of claim 1 wherein the first and second reservoirs and the exhaust are all coaxially aligned, the exhaust comprising a first cylindrical passage formed in the housing and the second reservoir comprising a second cylindrical passage formed in the housing, the valve having a diameter dimensioned to slide within the first cylindrical passage, the piston having a diameter dimensioned to slide within the second cylindrical passage, the diameter of the piston being slightly greater than the diameter of the valve.

8. The distraction device of claim 7 further comprising a removable cap coupled to the housing at the exhaust, the removable cap dimensioned to cover over the exhaust, the removable cap having a diaphragm configured to burst loudly when gas rapidly passes through the exhaust.

9. The distraction device of claim 4 wherein the first and second reservoirs and the exhaust are all coaxially aligned, the exhaust comprising a first cylindrical passage formed in the housing and the second reservoir comprising a second cylindrical passage formed in the housing, the valve having a diameter dimensioned to slide within the first cylindrical passage, the piston having a diameter dimensioned to slide within the second cylindrical passage, the diameter of the piston being slightly greater than the diameter of the valve.

10. The distraction device of claim 9 further comprising a removable cap coupled to the housing at the exhaust, the removable cap dimensioned to cover over the exhaust, the removable cap having a diaphragm configured to burst loudly when gas rapidly passes through the exhaust.

* * * * *